US009249003B2

(12) United States Patent
Reeves

(10) Patent No.: US 9,249,003 B2
(45) Date of Patent: Feb. 2, 2016

(54) TOOL HOLDER FOR AN AERIAL BUCKET LIFT

(71) Applicant: Safe Tree Products, LLC, Rehoboth, MA (US)

(72) Inventor: Albert W. Reeves, Rehoboth, MA (US)

(73) Assignee: SAFE TREE PRODUCTS, LLC, Rehoboth, MA (US)

( * ) Notice: Subject to any disclaimer, the term of this patent is extended or adjusted under 35 U.S.C. 154(b) by 129 days.

(21) Appl. No.: 14/091,414

(22) Filed: Nov. 27, 2013

(65) Prior Publication Data

US 2014/0151420 A1 Jun. 5, 2014

Related U.S. Application Data

(60) Provisional application No. 61/732,595, filed on Dec. 3, 2012, provisional application No. 61/749,523, filed on Jan. 7, 2013.

(51) Int. Cl.

| | |
|---|---|
| ***B27B 17/00*** | (2006.01) |
| ***B66F 13/00*** | (2006.01) |
| ***B66F 11/04*** | (2006.01) |
| ***B25H 3/00*** | (2006.01) |

(52) U.S. Cl.
CPC *B66F 13/00* (2013.01); *B25H 3/00* (2013.01); *B66F 11/04* (2013.01)

(58) Field of Classification Search
CPC ..... B60R 9/00; B66F 13/00; B26B 29/025; B27B 17/0008
USPC ..... 224/401, 560, 232, 234, 904, 584, 269, 224/482, 690–692, 303–304, 545, 547, 666, 224/409, 411, 407; 248/691–692, 303–308, 248/210–211, 238; D3/293
See application file for complete search history.

(56) References Cited

U.S. PATENT DOCUMENTS

| | | | | |
|---|---|---|---|---|
| 956,835 | A * | 5/1910 | Taulman | 224/560 |
| 2,524,875 | A * | 10/1950 | Beaver | 248/211 |
| 3,806,010 | A * | 4/1974 | Utigard | B62J 9/00 224/413 |
| 3,814,364 | A * | 6/1974 | Gargaro | 248/210 |
| 4,247,070 | A * | 1/1981 | Dirksing | 248/231.81 |
| 4,846,385 | A * | 7/1989 | Fratus | B23Q 13/00 224/402 |
| 5,713,499 | A * | 2/1998 | Daniel | 224/401 |
| 5,797,571 | A * | 8/1998 | Brophy | 248/210 |
| 6,045,017 | A * | 4/2000 | Connell | 224/148.7 |
| 2005/0056754 | A1* | 3/2005 | Salani | 248/309.1 |
| 2007/0170220 | A1* | 7/2007 | Fragassi, III | 224/660 |
| 2008/0164400 | A1* | 7/2008 | Beechinor | B27B 17/0008 248/500 |
| 2009/0147527 | A1* | 6/2009 | O'Connor | 362/396 |

* cited by examiner

*Primary Examiner* — Corey Skurdal
(74) *Attorney, Agent, or Firm* — Barlow, Josephs & Holmes, Ltd.

(57) ABSTRACT

A tool holder for a bucket lift is disclosed. The tool holder includes a backboard having left, right, front and back sides. A left side member and a right side member are attached to the left side and right side, respectively, of the backboard. A scabbard portion is attached to the front side of the backboard; the scabbard portion forms a pocket between the scabbard portion and backboard. A left hook and a right hook extend from the left side member and right side member respectively, the left hook and right hook are configured and arranged to couple to a bucket of an aerial bucket lift.

14 Claims, 14 Drawing Sheets

TOOL HOLDER FOR AN AERIAL BUCKET LIFT

CROSS-REFERENCE TO RELATED APPLICATIONS

This patent document claims priority to earlier filed U.S. Provisional Patent Application Ser. No. 61/732,595, filed Dec. 3, 2012, and U.S. Provisional Patent Application Ser. No. 61/749,523, filed Jan. 7, 2013, the entire contents of which are incorporated by reference.

BACKGROUND

1. Technical Field

The present patent document relates generally to tool holders, and more specifically to tool holders for use in aerial bucket lifts.

2. Background of the Related Art

Tradesmen that cut and trim tree branches from a bucket of an aerial bucket lift have dangerous jobs that are complicated by the fact that they are often wielding sharp tools such as chainsaws and hand saws. The small confines of the bucket also provides the additional complication of not providing a convenient and safe place to temporarily hold a chainsaw or hand saw if the tradesman needs to use both hands. Although there are prior art holders for chainsaws and handsaws, these prior art devices are often made or lightweight plastic or fiberglass, which is prone to chipping and cracking. Consequently, tradesmen often rip pants and cut their legs on jagged holders or the sharp blades of their tools.

Therefore, there is a perceived need in the industry for a method to hold tools, such as a chainsaw and other sharp implements, that protects the tradesmen from injury and that is durable and rugged.

SUMMARY

The present invention solves the problems of the prior art by providing a tool holder that may be hung on the interior (or alternatively the exterior) of a bucket of an aerial bucket lift, which securely holds the tool. The tool holder is manufactured from a heavy gauge, high-density plastic that resists chipping and cracking.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
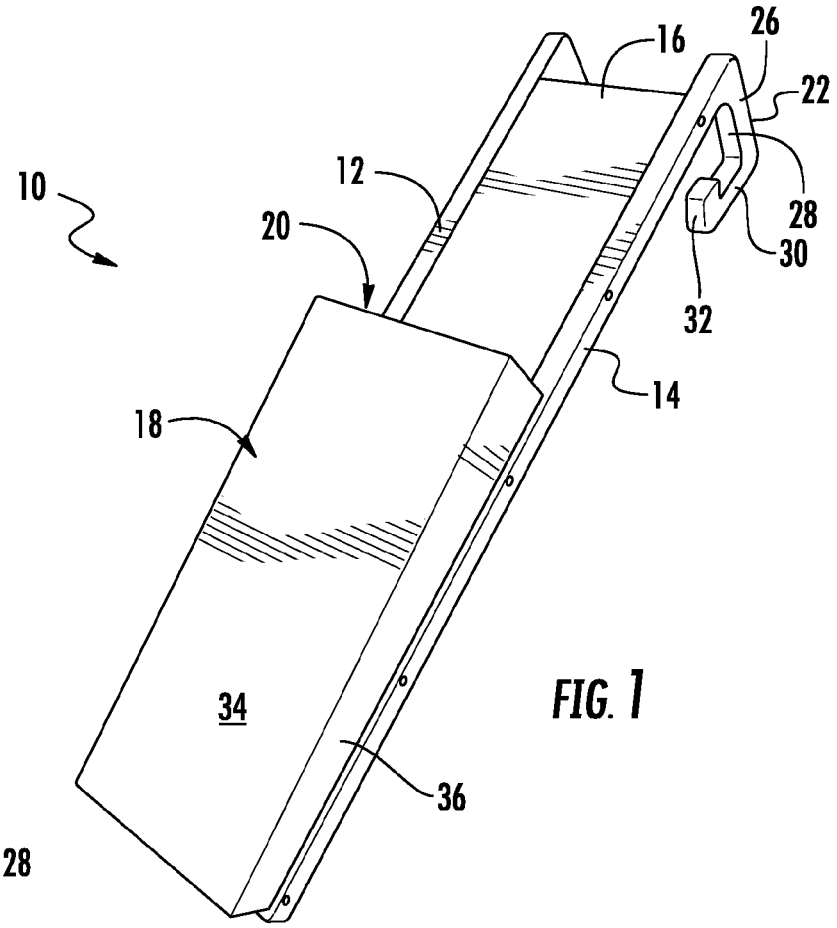
FIG. 1 shows a front perspective view of an embodiment of a tool holder adapted as a chainsaw scabbard.
Figure 2:
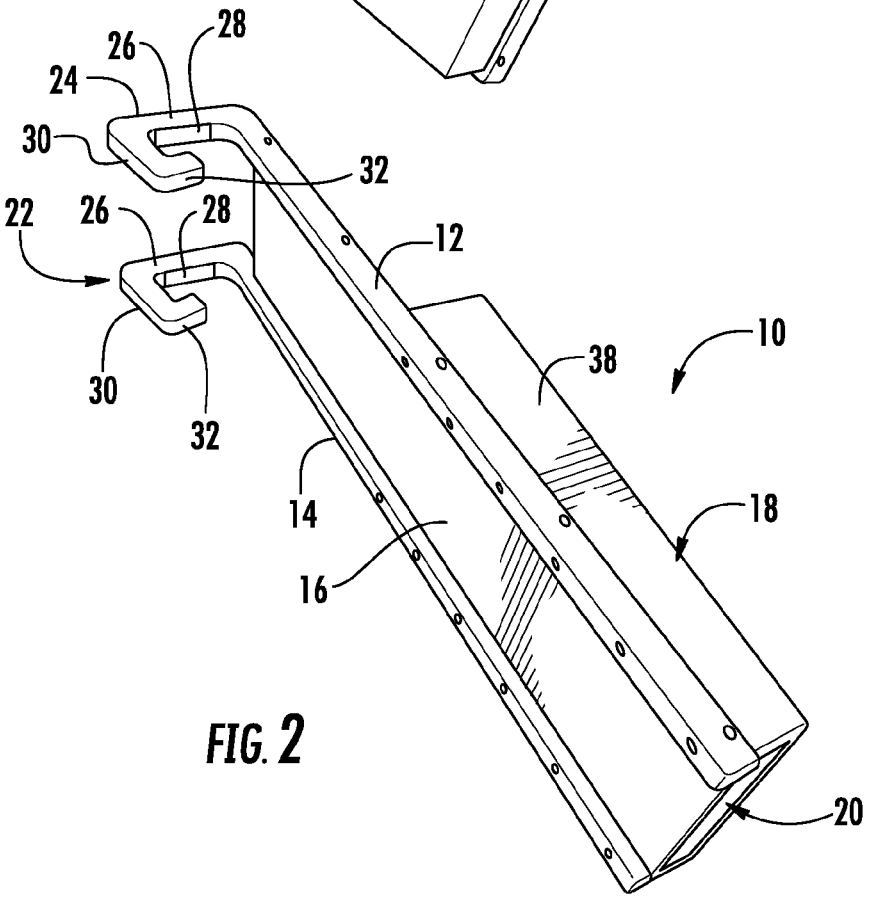
FIG. 2 shows a rear perspective view of an embodiment of a tool holder adapted as a chainsaw scabbard.
Figure 3:
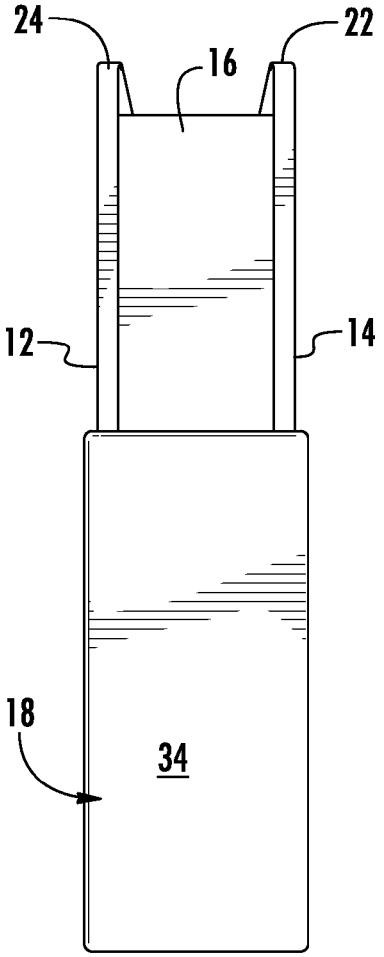
FIG. 3 shows a front view of an embodiment of a tool holder adapted as a chainsaw scabbard.
Figure 4:
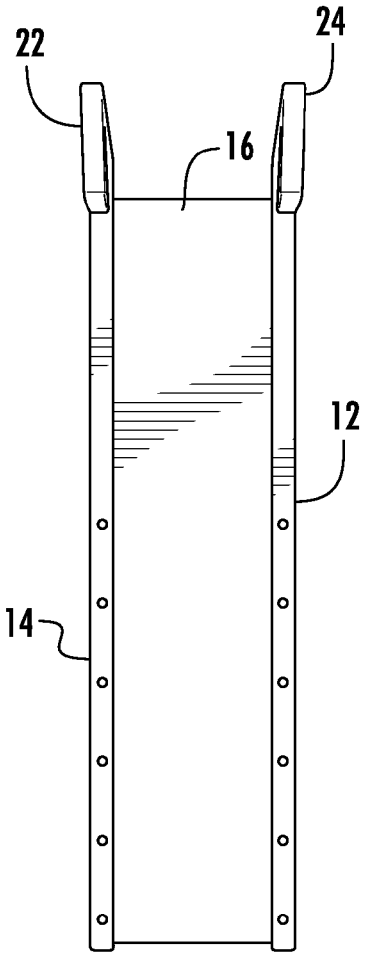
FIG. 4 shows a rear view of an embodiment of a tool holder adapted as a chainsaw scabbard.
Figure 5:
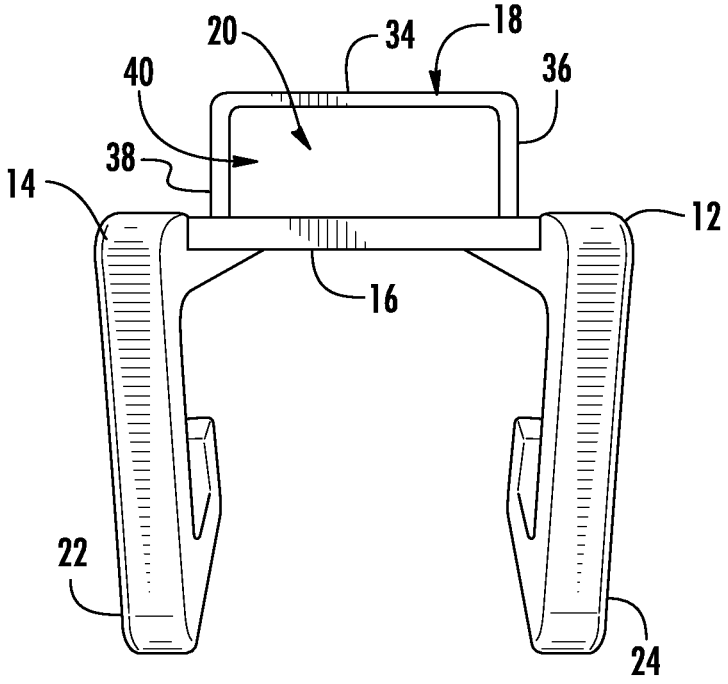
FIG. 5 shows a top view of an embodiment of a tool holder adapted as a chainsaw scabbard.
Figure 6:
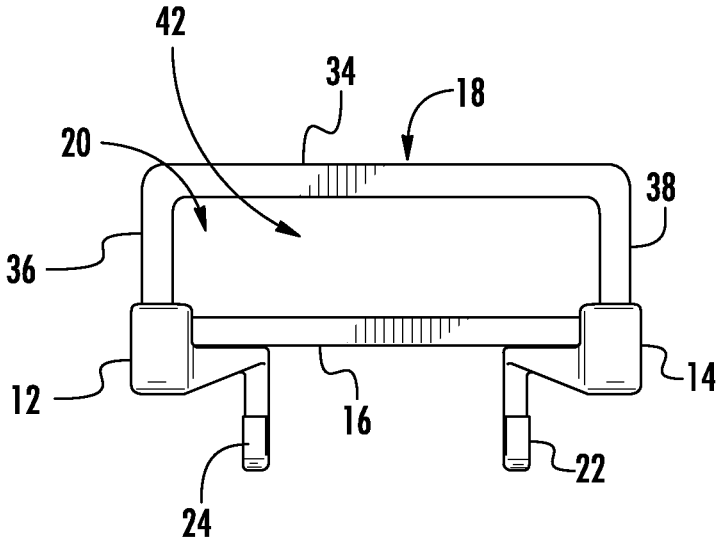
FIG. 6 shows a bottom view of an embodiment of a tool holder adapted as a chainsaw scabbard.

Referring to FIGS. 1-7, a first embodiment of a tool holder adapted as a chainsaw scabbard is shown generally at 10. The chainsaw scabbard 10 has a left side member 12 and a right side member 14 fastened to a backboard 16. A scabbard portion 18 is fastened to the left side member 12 and the right side member 14 forming a pocket 20 to hold a blade of a chainsaw.

Extending from the left side member 12 and the right side member 14 are a left hook 22 and a right hook 24, respectively. The left hook 22 and right hook 24 each include a top portion 26 extending laterally and rearwards from the respective left side or right side members 12, 14. Underneath the top portion 26, padded or rubberized tape 28 may be added to prevent lateral slipping and sliding on the bucket 99.

Depending downwards from the top portion 26 is a back support portion 30 with a foot 32 extending inwardly therefrom, or rather, back towards the left or right side portion 12, 14, respectively. The foot portion 32 provides bracing against an exterior wall of a bucket 99 or an aerial bucket lift.

The scabbard portion 18 has a front 34, left 36 and right 38 sides. The left and right sides 36, 38 are fastened to the left and right side members 12, 14, respectively. The backboard, front, left and right sides 34, 36, 38 taper inward, forming a generally trapezoidal (from the side) pocket for the blade of the chainsaw, with a wider mouth 40 at the top and shallower opening 42 at the bottom.

Figure 8:
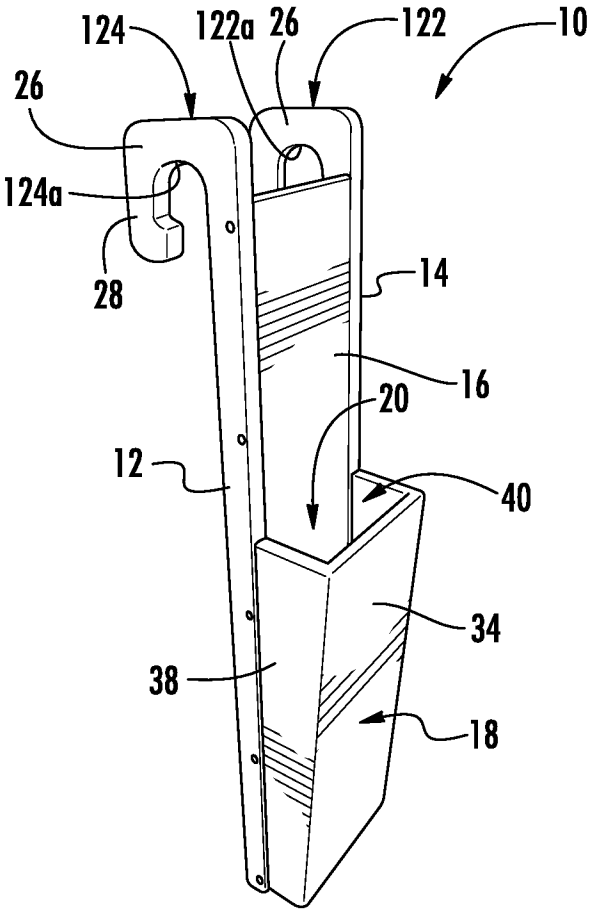
FIG. 8 shows a perspective view of an alternative embodiment of a tool holder adapted as a chainsaw scabbard for a pipe-style bucket of an aerial bucket lift.
Figure 7:
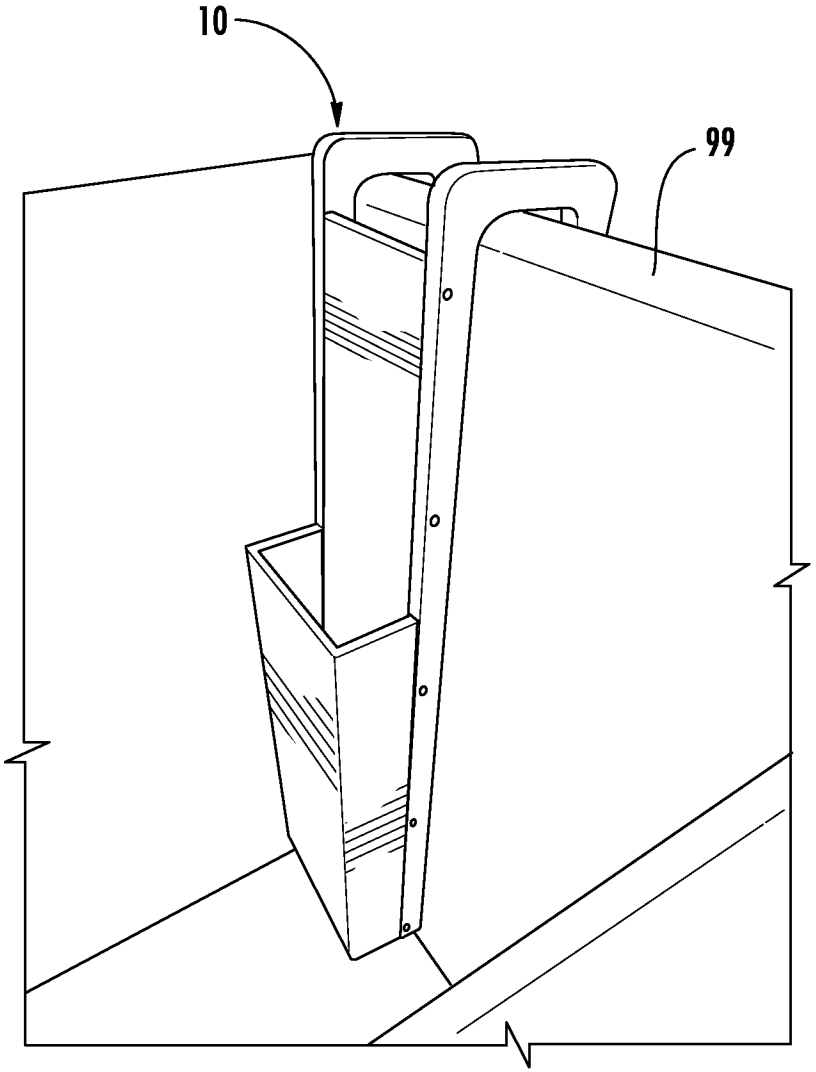
FIG. 7 shows an embodiment of a tool holder adapted as a chainsaw scabbard hung on the interior of a bucket of an aerial bucket lift.

Referring to FIG. 8, an alternative embodiment of a tool holder adapted as a chainsaw scabbard configured for hooking on a pipe-style bucket, is shown generally at 100. The alternative embodiment is similar to the embodiment shown in FIGS. 1-7 at 10, except for the left and right hooks 124, 126. The left and right hooks 124, 126 have a semi-circular surface 124*a*, 126*a* on the top portion 24 and back support portion 26 configured to cup a pipe on a pipe-style bucket of an aerial bucket lift.

Figure 10:
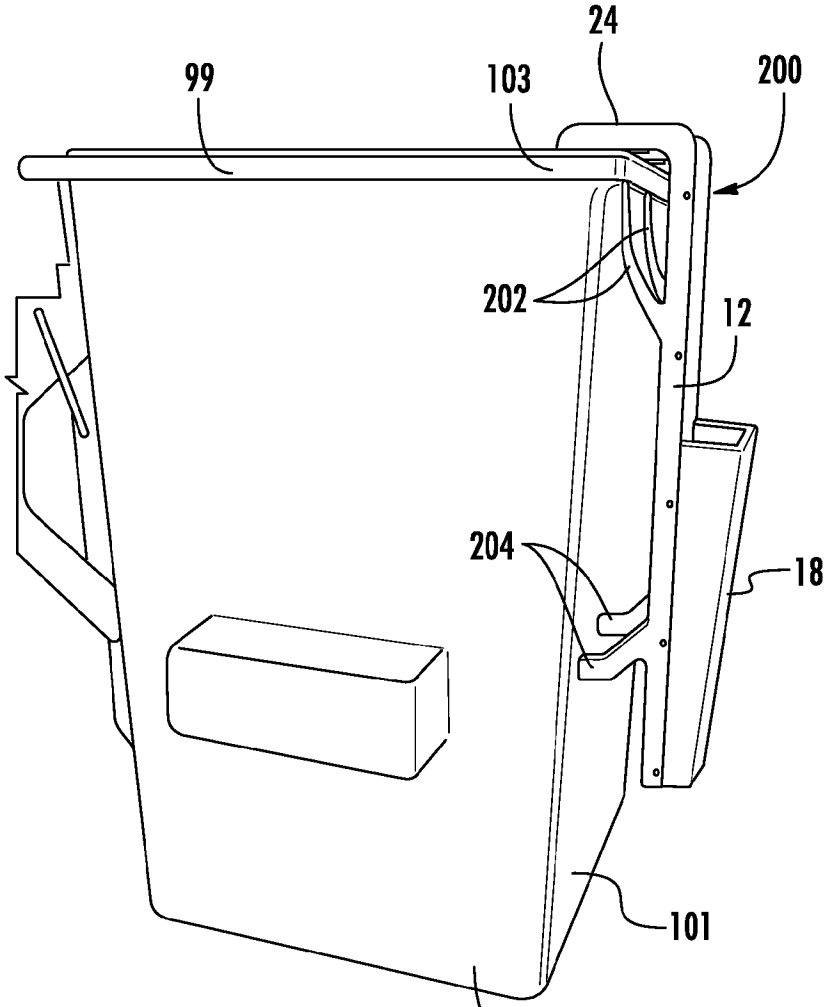
FIG. 10 shows an alternative embodiment of a tool holder adapted as a chainsaw scabbard hung on the exterior of a bucket of an aerial bucket lift.
Figure 9:
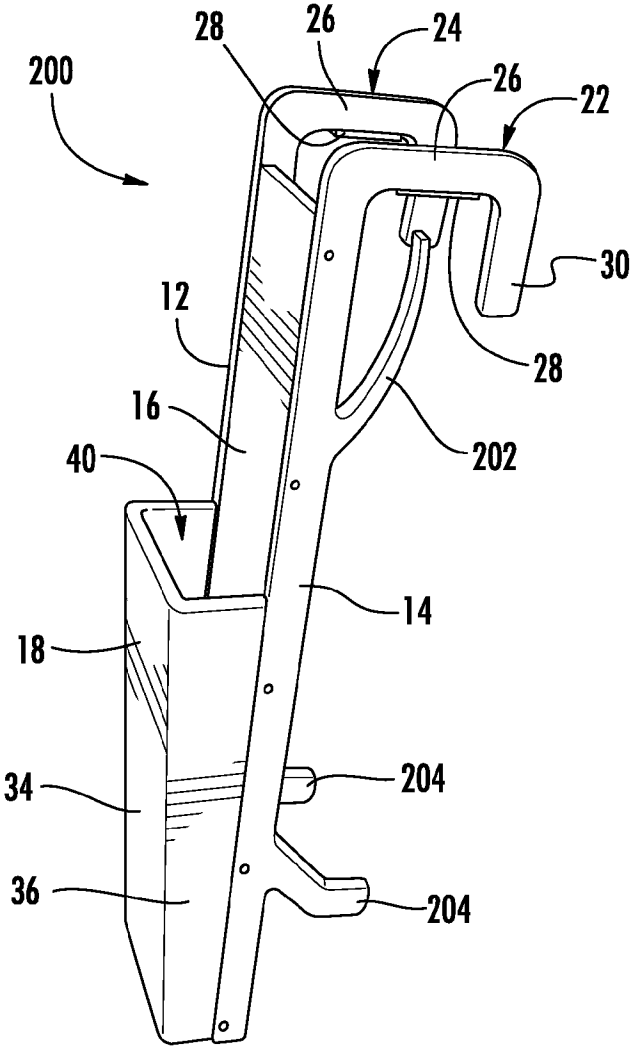
FIG. 9 shows a perspective view of an alternative embodiment of a tool holder adapted as a chainsaw scabbard configured for mounting externally on a bucket of an aerial bucket lift.

Referring to FIGS. 9 and 10, show an alternative embodiment 200 of a tool holder adapted as a chainsaw scabbard configured for external mounting on a bucket 99 of an aerial bucket lift. The alternative embodiment 200 includes all the same features as the embodiment shown in FIGS. 1-7, but also includes additional upper support braces 202 and lower support braces 204 extending from the left and right side members 12, 14, respectively. The foot portions on the right and left hooks are also omitted. The upper and lower support braces 202, 204 ensure that the chainsaw scabbard hangs vertically (i.e. plumb) with respect to the sidewalls 101 of the bucket. The sidewalls 101 on buckets 99 typically taper inwardly, having a narrower bottom and wider top. When mounted, the upper braces 202 reach under a lip 103 formed at the upper end of the bucket, providing additional bracing.

Figure 12:
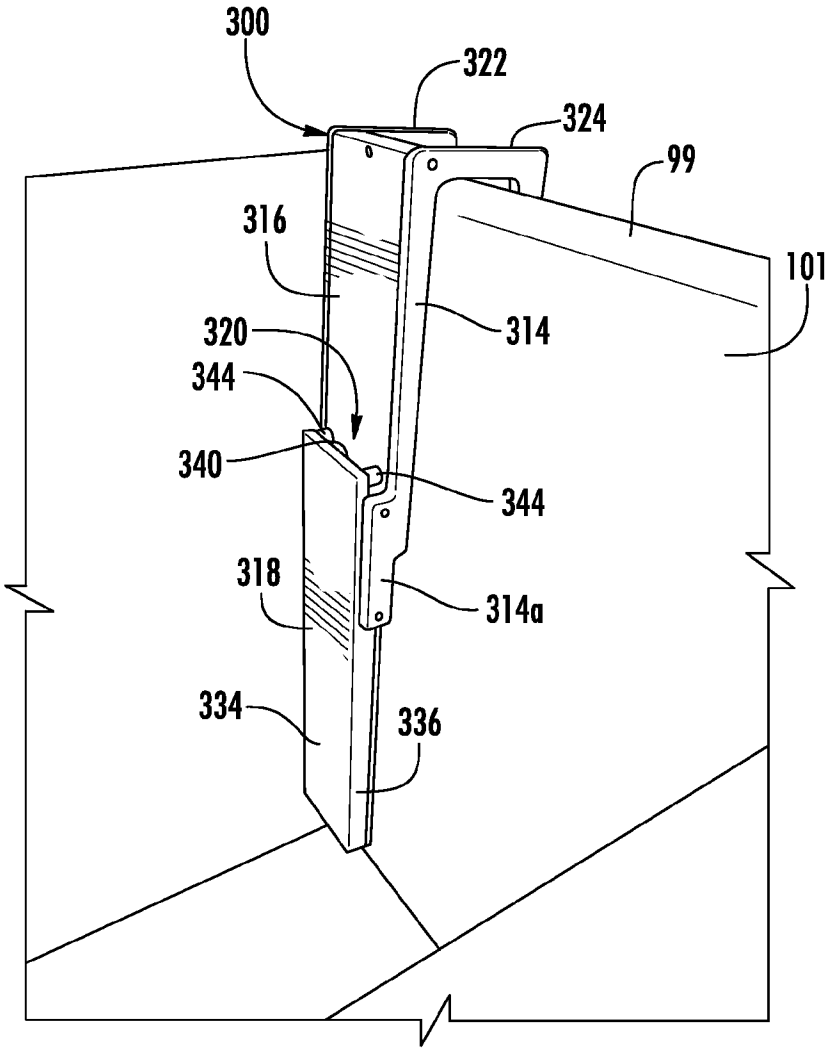
FIG. 12 shows an embodiment of a tool holder adapted as a hand saw scabbard hung on the interior of a bucket of an aerial bucket lift.
Figure 11:
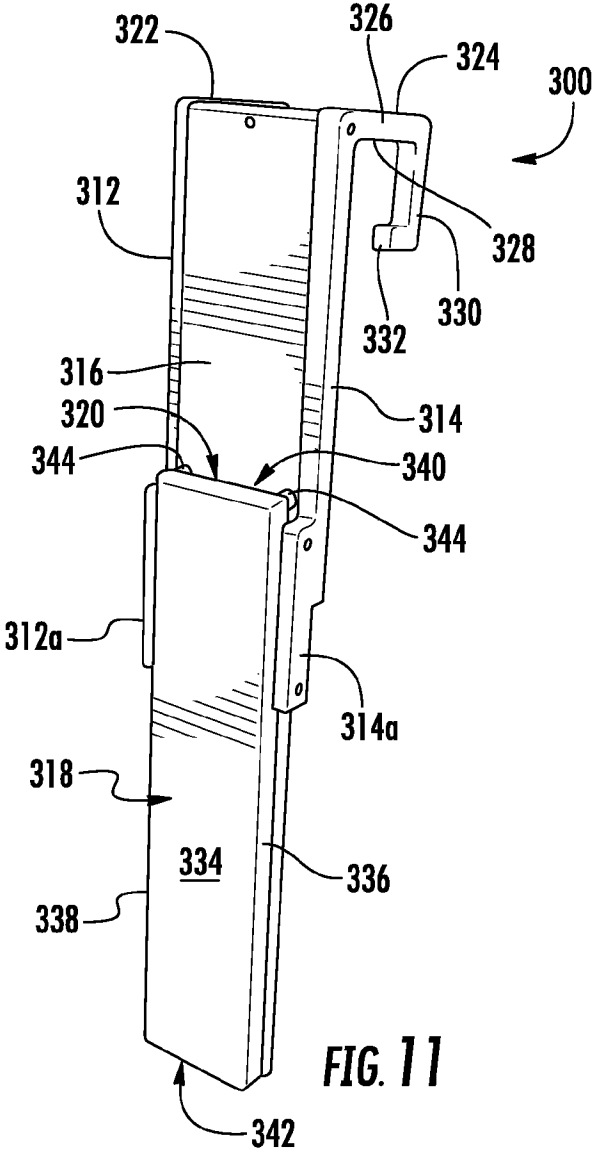
FIG. 11 shows a perspective view of an embodiment of a tool holder adapted as a hand saw scabbard.
Figure 13:
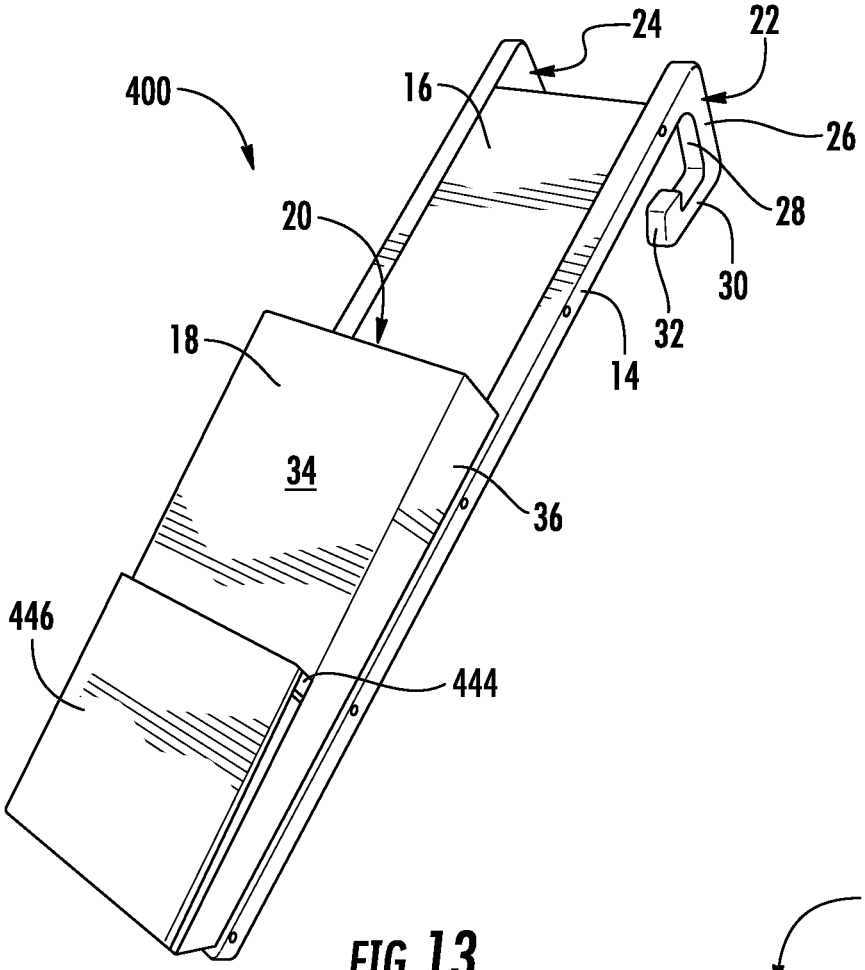
FIG. 13 shows a front perspective view of an alternative embodiment of a tool holder adapted as a chainsaw scabbard with an optional hand saw scabbard attachment.
Figure 14:
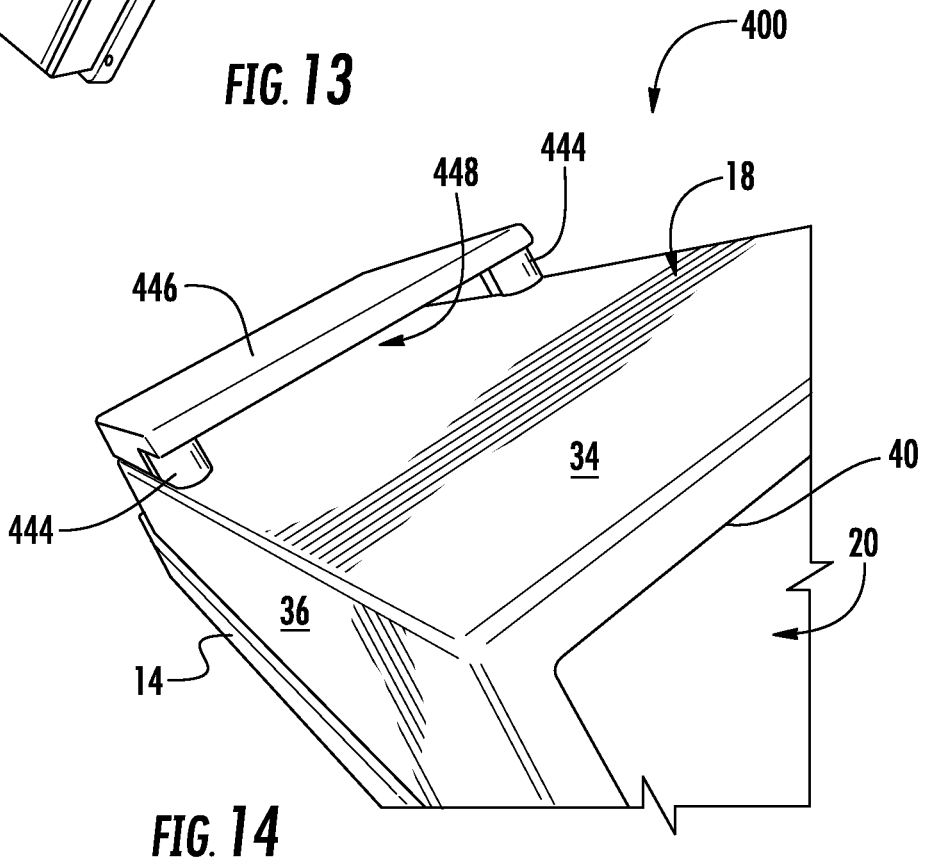
FIG. 14 shows a top perspective view of an alternative embodiment of a tool holder adapted as a chainsaw scabbard with an optional hand saw scabbard attachment.
Figure 15:
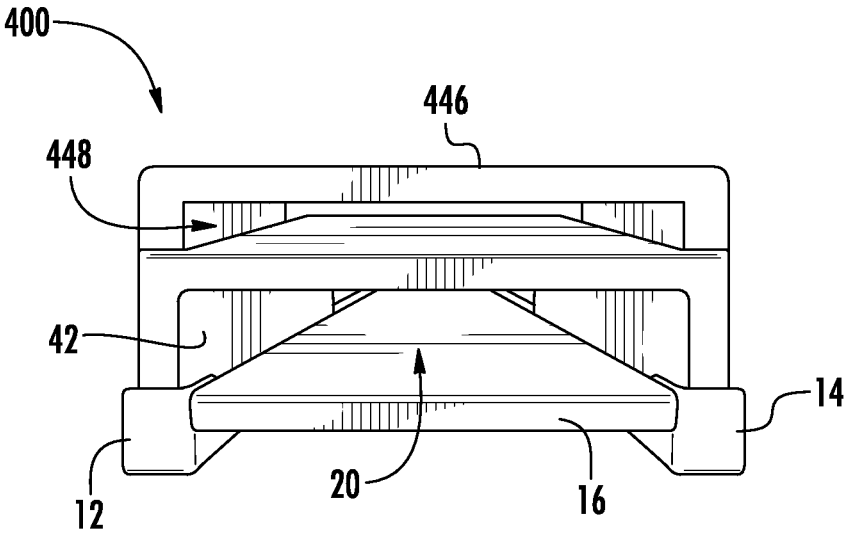
FIG. 15 shows a bottom perspective view of an alternative embodiment of a tool holder adapted as a chainsaw scabbard with an optional hand saw scabbard attachment.
Figure 16:
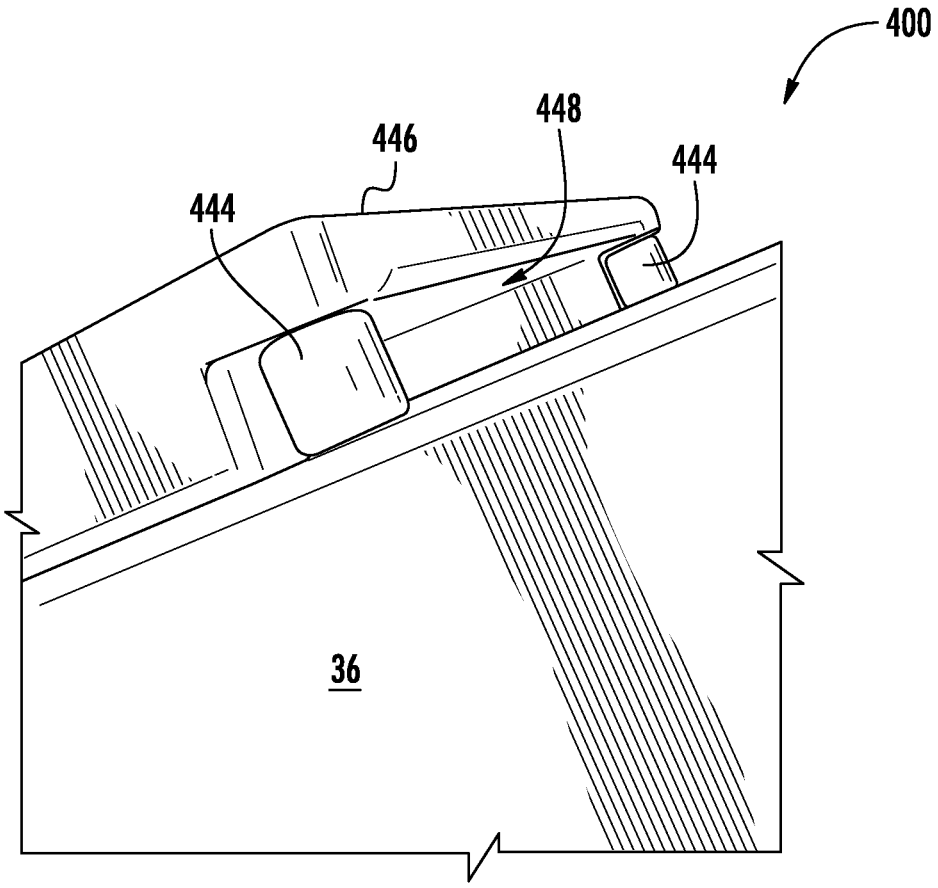
FIG. 16 shows a close up view of rollers at the opening on the hand saw scabbard, to prevent chipping and cracking.
Figure 17:
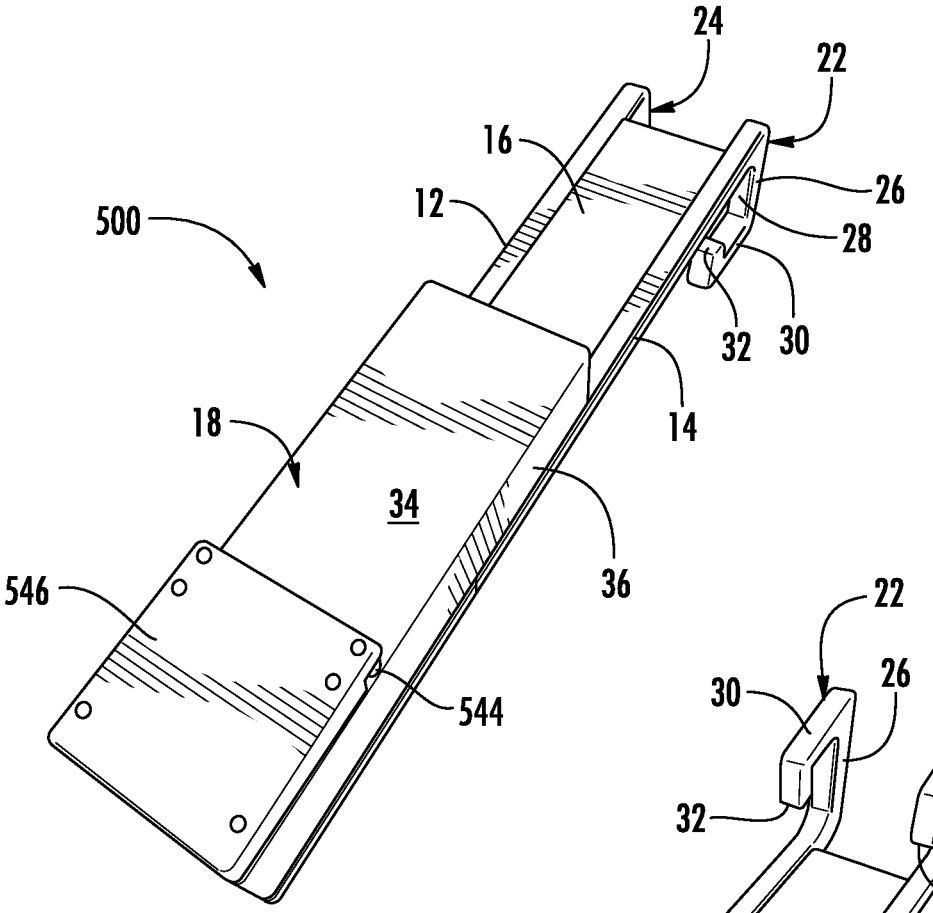
FIG. 17 shows a front perspective view of an alternative, narrower (i.e. skinnier) embodiment of a tool holder adapted as a chainsaw scabbard, for smaller chainsaw, with an optional hand saw scabbard attachment.
Figure 18:
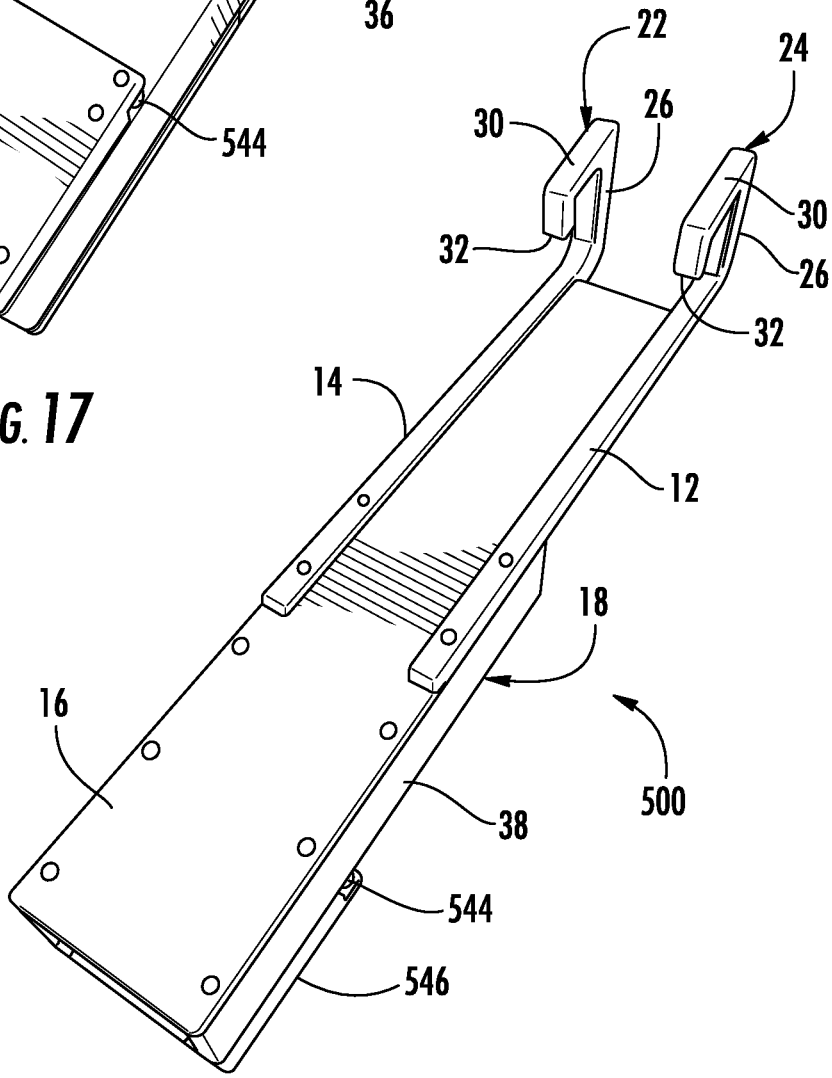
FIG. 18 shows a rear perspective view of an alternative, narrower (i.e. skinnier) embodiment of a tool holder adapted as a chainsaw scabbard, for smaller chainsaws, with an optional hand saw scabbard attachment.
Figure 19:
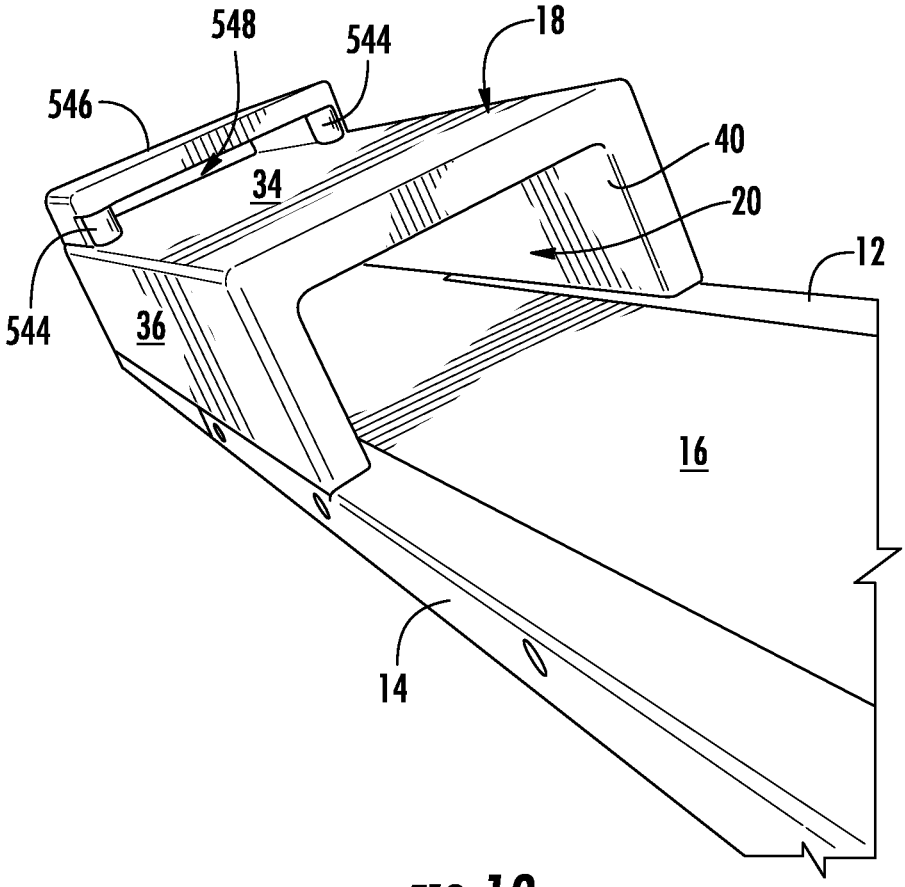
FIG. 19 shows a top perspective view of an alternative, narrower (i.e. skinnier) embodiment of a tool holder adapted as a chainsaw scabbard, for smaller chainsaws, with an optional hand saw scabbard attachment.
Figure 20:
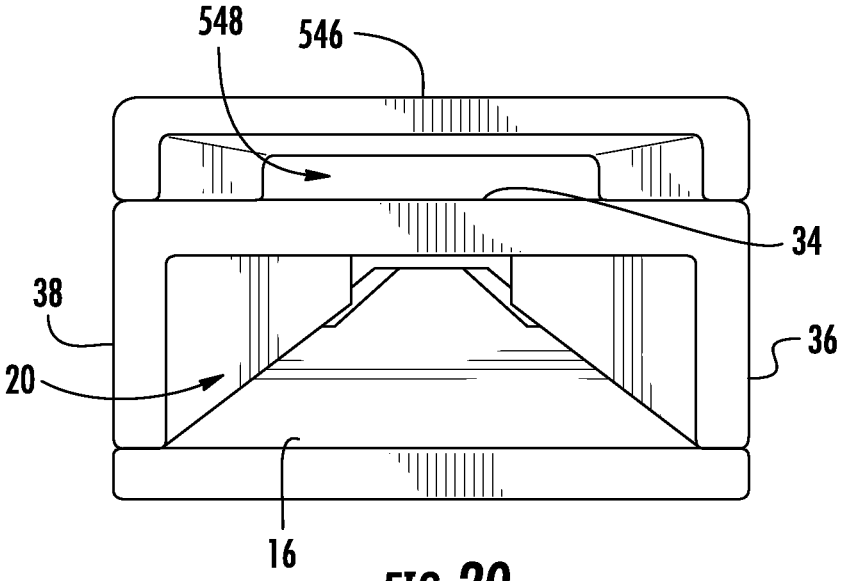
FIG. 20 shows a bottom perspective view alternative, narrower (i.e. skinnier) embodiment of a tool holder adapted as a chainsaw scabbard, for smaller chainsaws, with an optional hand saw scabbard attachment.
Figure 22:
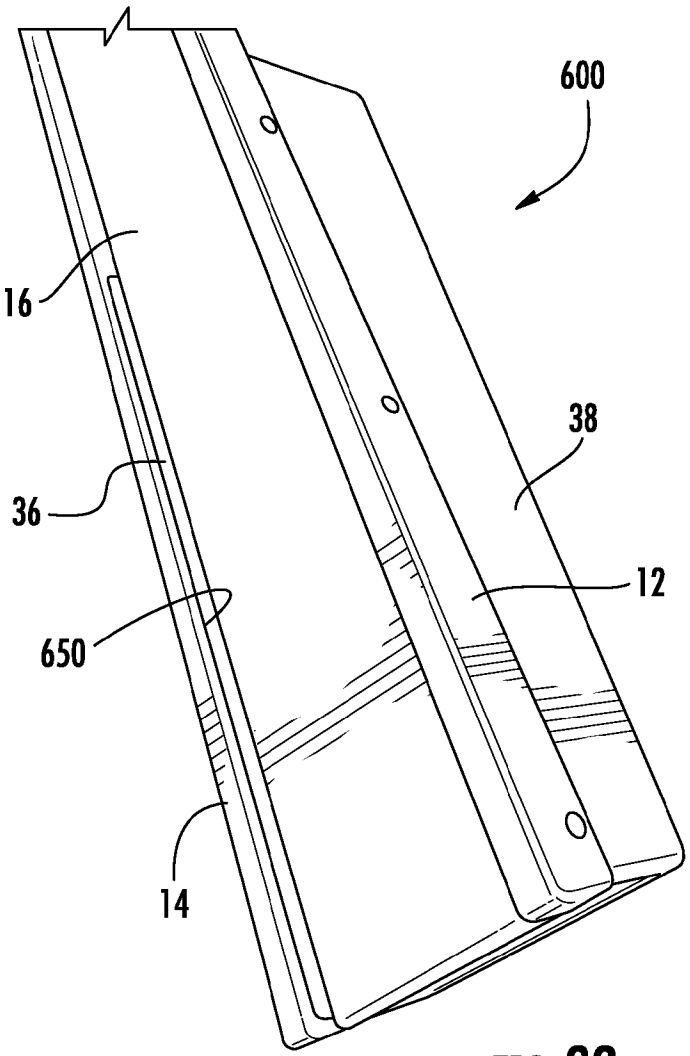
FIG. 22 shows a rear perspective view of another alternative embodiment of a tool holder adapted as the chainsaw scabbard.
Figure 21:
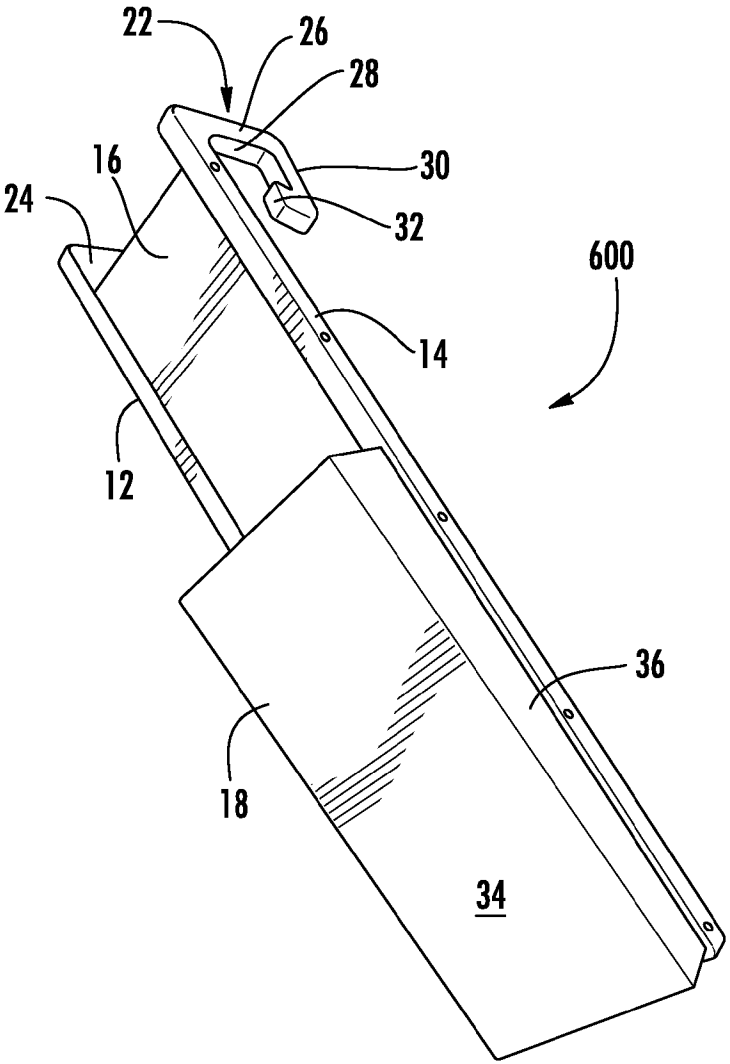
FIG. 21 shows a front perspective view of another alternative embodiment of a tool holder adapted as chainsaw scabbard with an alternative assembly method to minimize or eliminate the chance of the chainsaw blade being damaged by fasteners on the tool holder.
Figure 23:
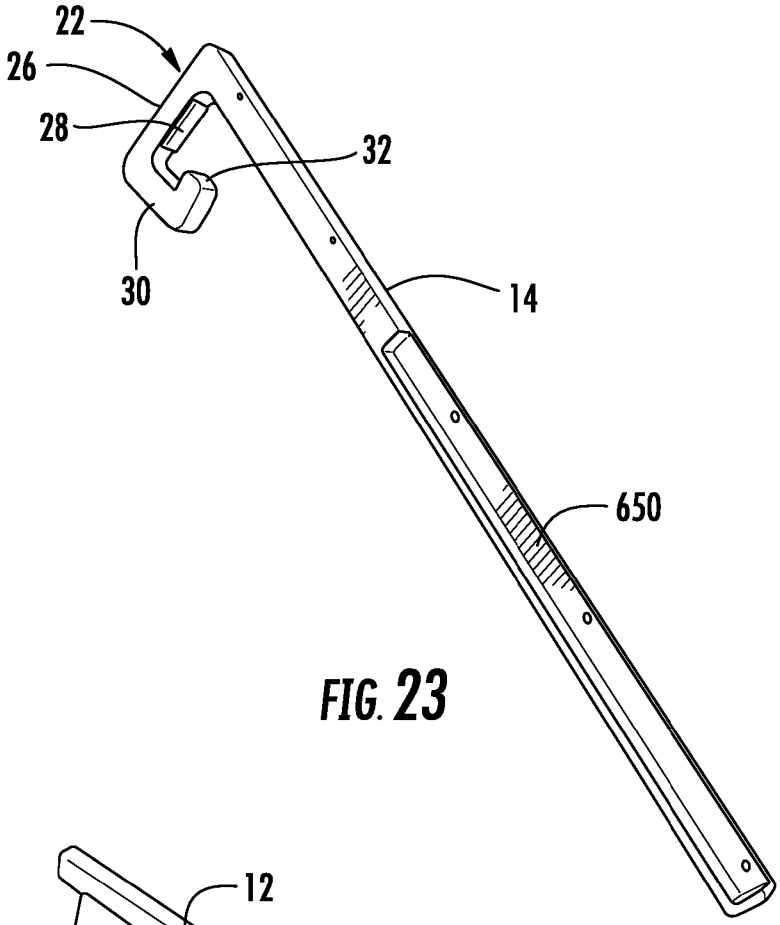
FIG. 23 shows a perspective view of a left side member showing a hogged out portion to receive an edge of the scabbard portion.
Figure 24:
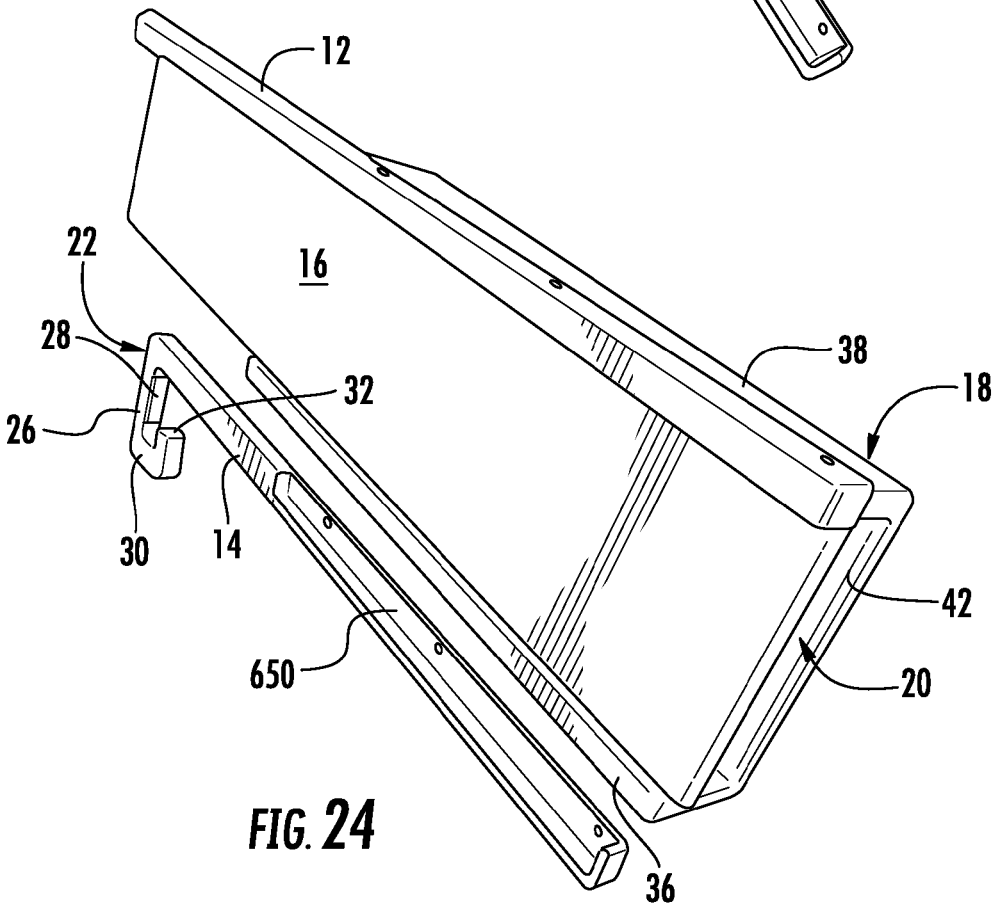
FIG. 24 shows a rear perspective view of the alternative embodiment of a tool holder adapted as the chainsaw scabbard with the left side member removed.

Referring to FIGS. 11 and 12, an embodiment of a tool holder adapted as a hand saw scabbard is shown at 300, which includes the features of the larger, chainsaw scabbard 100. The hand saw scabbard 300 has a left side member 312 and a right side member 314 fastened to a backboard 316. A scabbard portion 318 is fastened to the left side member 312 at an extension portion 312*a* and the right side member 314 at an extension portion 314*a* and the backboard 316, forming a pocket 320 to hold a blade of a hand saw. The extension portions 312*a*, 314*a* extend outwards from the left side portion 312 and right side portion 314, respectively.

Extending from the left side member 312 and the right side member 314 are a left hook 322 and a right hook 324, respectively. The left hook 322 and right hook 324 each include a top portion 326 extending laterally and rearwards from the respective left side or right side members 312, 314. Underneath the top portion 326, padded or rubberized tape 328 may be added to prevent lateral slipping and sliding on the bucket 99.

Depending downwards from the top portion 26 is a back support portion 330 with a foot 332 extending inwardly therefrom, or rather, back towards the left or right side portion 312, 314, respectively. The foot portion 332 provides bracing against an exterior wall of a bucket 99 or an aerial bucket lift.

The scabbard portion 18 has a front 334, left 336 and right 338 sides. The left and right sides 336, 338 are fastened to the left and right side members 12, 14, respectively. The backboard, front, left and right sides 334, 336, 338 may taper inward, forming a generally trapezoidal (from the side) pocket for the blade of the chainsaw, with a wider mouth 340 at the top and shallower opening 342 at the bottom.

At corners of the mouth 340 of the pocket 320 are a pair of rollers 344. The rollers 344 facilitate putting a tool into the scabbard portion 318 by reducing snagging, chipping and cracking by the teeth of the blade of the hand saw.

Referring to FIGS. 13-16 an alternative embodiment 400 of a tool holder adapted as a chainsaw scabbard is shown with an optional hand saw scabbard 446 attached to the front 34 of the scabbard portion 18. The alternative embodiment 400 includes all the same features as the embodiment 100 shown in FIGS. 1-7, but also includes an additional hand saw scabbard attachment 446 fastened to the front 34 of the scabbard portion 18. The hand saw scabbard portion 446 includes rollers 444 at an opening 448 formed between the hand saw scabbard portion 446 and the front 34 of the scabbard portion 18, which prevents the teeth of the hand saw from snagging and chipping and cracking the hand saw scabbard attachment 446.

Referring to FIGS. 17-20, a narrower (i.e. skinnier), alternative embodiment 500 of a tool holder adapted as a chainsaw scabbard, for smaller chainsaws, with an optional hand saw scabbard attachment 546 is shown. The alternative embodiment 500 includes all the same features as the embodiment 100 shown in FIGS. 1-7, but is generally narrower for smaller bladed chainsaws. Also notably different is the left and right side members 12, 14 do not extend the length of the backboard 16 and the scabbard portion 18 is fastened to both the left and right side members 12, 14 and the backboard 16. The had saw scabbard 546 includes the same features as the hand saw scabbard 446 depicted in the embodiment 400 shown in FIGS. 13-16, including rollers 544 and an opening 548 to receive the blade of a hand saw.

Referring to FIGS. 21-24, another alternative embodiment 600 is shown of a tool holder adapted as a chainsaw scabbard, which eliminates the chances of the chainsaw blade from impacting a fastener, thereby reducing the likelihood of damage to the chainsaw. Because the tool holder 600 is made from a softer material than a chainsaw blade, such as a high density plastic, the tool holder 600 will wear over time as the blades contact the interior of the scabbard portion 18. In particular, the sides 36, 38 of the scabbard portion 18 are prone to wear early, exposing rear-to-front fasteners that secure the scabbard portion 18 to the side members 36, 38. The fasteners are often made of metal, which can dull or even break the blades on the chainsaw.

In this alternative embodiment 600 the left and right side members 12, 14 have a hogged out portion 650 sized to cup an edge of the scabbard portion 18. Fasteners are driven laterally through the side members 12, 14, through the scabbard portion 18 and into the backboard 16, thereby securing the entire assembly together. Because the lateral fasteners now secure the scabbard portion 18 as well as the side members 12, 14 and backboard 16 together, rear-to-front fasteners are no longer needed.

Figure 25:
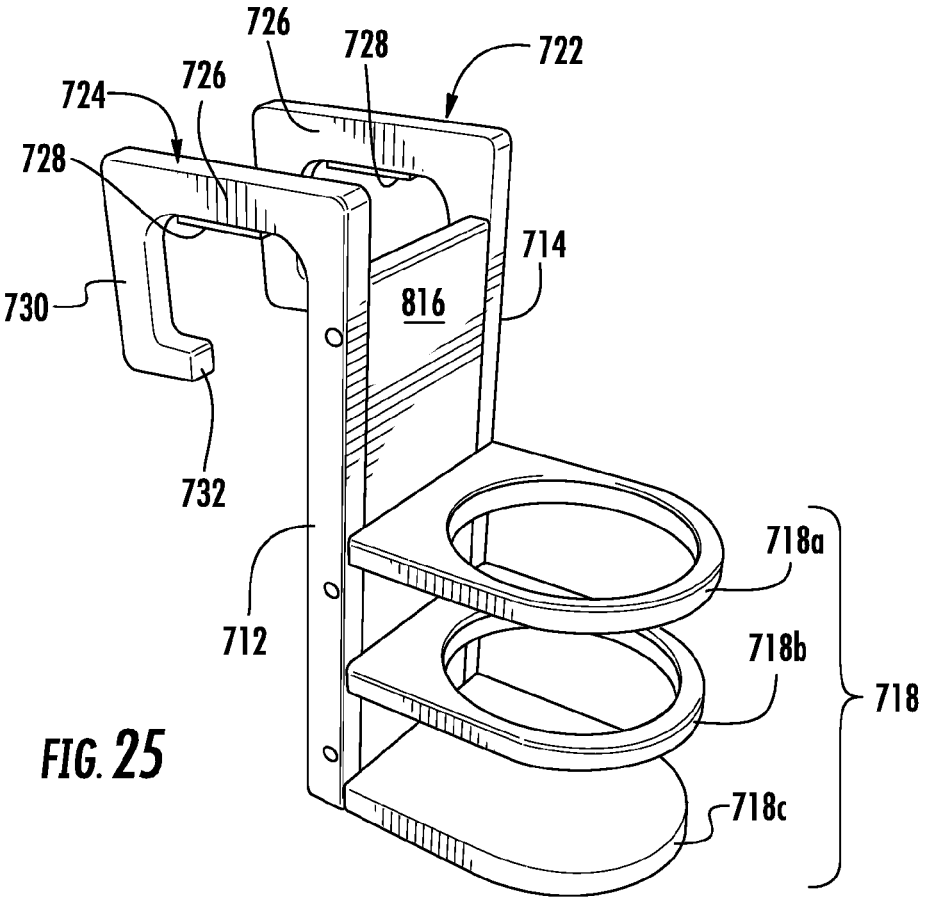
FIG. 25 shows a front perspective view of an embodiment of a tool holder adapted as a cup holder for hanging on an interior of a bucket lift.
Figure 26:
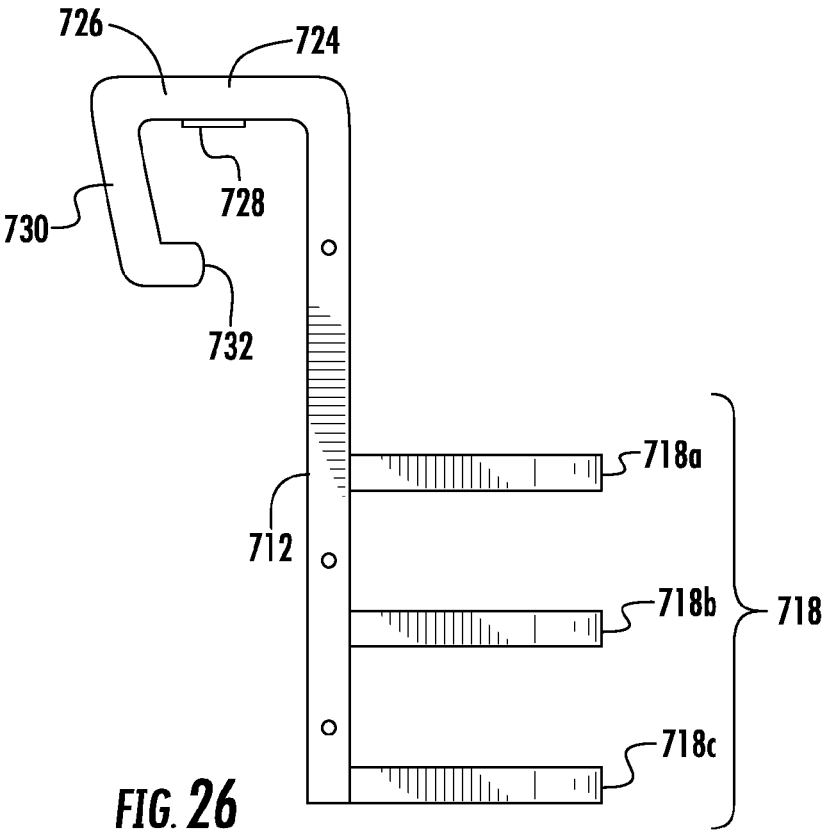
FIG. 26 shows a left side view of an embodiment of a tool holder adapted as a cup holder for hanging on an interior of a bucket lift.

Referring to FIGS. 25 and 26, an embodiment of a tool holder adapted as a cup holder is shown generally at 700. This embodiment 700 includes a left side member 712 and a right side member 714 fastened to a backboard 716. A scabbard portion 718, comprising two rings 718*a*, 718*b*, and a bottom plate 718*c*, are fastened to the left side member 712 and the right side member 714 forming a pocket 720 to hold a cup or other cylindrical object.

Extending from the left side member 712 and the right side member 714 are a left hook 722 and a right hook 724, respectively. The left hook 722 and right hook 724 each include a top portion 726 extending laterally and rearwards from the respective left side or right side members 712, 714. Underneath the top portion 726, padded or rubberized tape 728 may be added to prevent lateral slipping and sliding on the bucket 99.

Depending downwards from the top portion 726 is a back support portion 730 with a foot 732 extending inwardly therefrom, or rather, back towards the left or right side portion 712, 714, respectively. The foot portion 732 provides bracing against an exterior wall of a bucket 99 or an aerial bucket lift.

Figure 27:
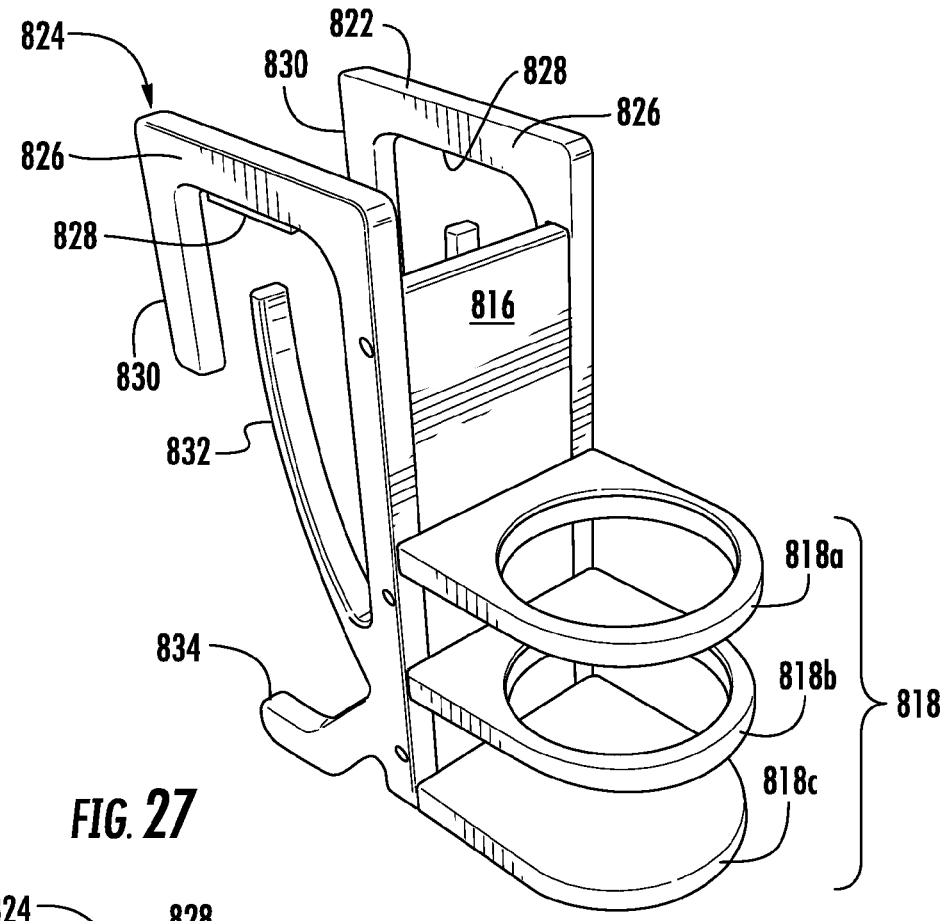
FIG. 27 shows a front perspective view of an alternative embodiment of a tool holder adapted as a cup holder for hanging on an exterior of a bucket lift.
Figure 28:
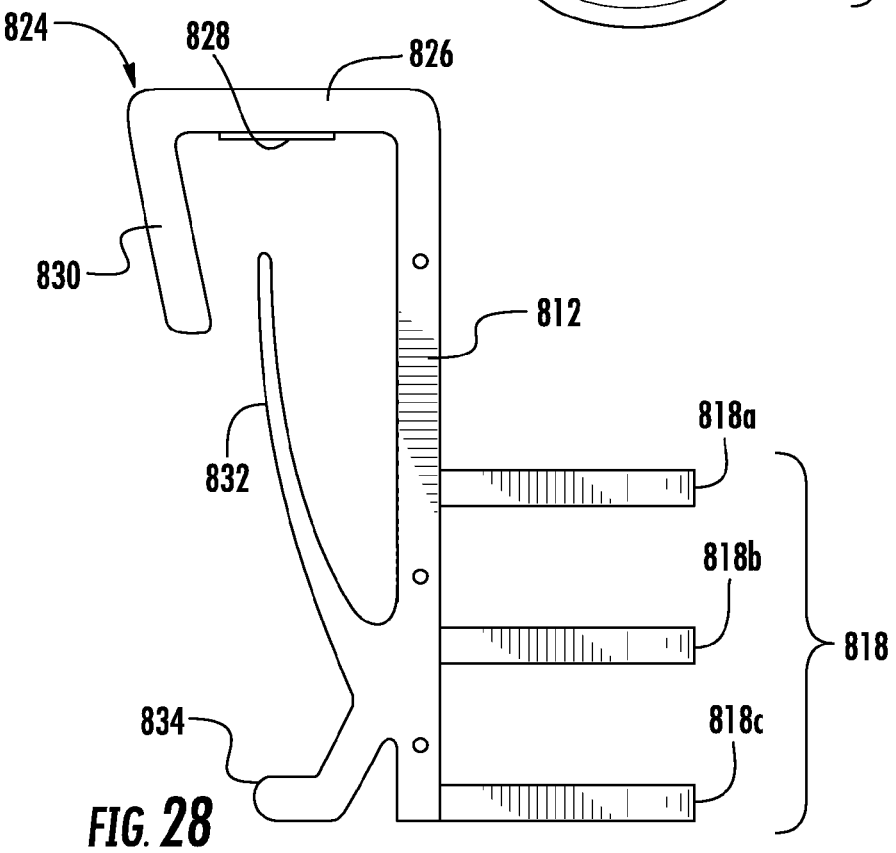
FIG. 28 shows a left side view of an alternative embodiment of a tool holder adapted as a cup holder for hanging on an exterior of a bucket lift.

Referring to FIGS. 27 and 28, an alternative embodiment of a tool holder adapted as a cup holder is shown generally at 800. This embodiment 800 includes a left side member 812 and a right side member 814 fastened to a backboard 816. A scabbard portion 818, comprising two rings 818*a*, 818*b*, and a bottom plate 818*c*, are fastened to the left side member 812 and the right side member 814 forming a pocket 820 to hold a cup or other cylindrical object.

Extending from the left side member 812 and the right side member 814 are a left hook 822 and a right hook 824, respectively. The left hook 822 and right hook 824 each include a top portion 826 extending laterally and rearwards from the respective left side or right side members 812, 814. Underneath the top portion 826, padded or rubberized tape 828 may be added to prevent lateral slipping and sliding on the bucket 99.

Depending downwards from the top portion 826 is a back support portion 830. Additional upper support braces 832 and lower support braces 834 extending from the left and right side members 812, 814, respectively. The upper and lower support braces 832, 834 ensure that the chainsaw scabbard hangs vertically (i.e. plumb) with respect to the sidewalls 101 of the bucket. When mounted, the upper braces 832 reach under a lip 103 formed at the upper end of the bucket, providing additional bracing.

Therefore, it can be seen that the present tool holder for a bucket lift provides a unique solution to the problem of providing a secure place to place tools in a bucket lift that keeps the operator safe.

It would be appreciated by those skilled in the art that various changes and modifications can be made to the illustrated embodiments without departing from the spirit of the present invention. All such modifications and changes are intended to be within the scope of the present invention.

What is claimed is:

1. A chainsaw scabbard for a bucket lift, comprising:

a backboard having left, right, front and back sides;

a left side member and a right side member attached to the left side and right side, respectively, of the backboard, forming a backboard assembly;

a scabbard portion having a left side, right side and front side, the left side and right side of the scabbard portion attached to the backboard assembly, the scabbard portion forming a trapezoidal pocket between the scabbard portion and backboard, with a wider mouth at a top of the pocket and shallower opening at a bottom of the pocket, configured and arranged to hold a blade of a chainsaw therethrough; and a left hook and a right hook extending from the left side member and right side member respectively, the left hook and right hook configured and arranged to couple to a bucket of an aerial bucket lift.

2. The chainsaw scabbard of claim 1, wherein the left hook and right hook include a semi-circular surface configured for hanging on a pipe-style bucket of an aerial bucket lift.

3. The chainsaw scabbard of claim 1, wherein the left side member and the right side member include a hogged out portion configured to receive a left side and a right side of the scabbard portion, respectively.

4. The chainsaw scabbard of claim 1, further comprising rollers on the scabbard portion at an open mouth formed between the backboard and scabbard portion.

5. The chainsaw scabbard of claim 1, further comprising a hand saw scabbard attached to a front of the scabbard portion.

6. The chainsaw scabbard of claim 5, wherein the hand saw scabbard further includes rollers at an open end thereof.

7. The chainsaw scabbard of claim 1, wherein the left side member, right said member, backboard and scabbard portion are attached via fasteners that are fastened laterally through the side members and scabbard portion, and into the backboard.

8. The chainsaw scabbard of claim 1, further comprising rubberized tape on the left hook and right hook.

9. The chainsaw scabbard of claim 1, wherein the left side member and right side member each further comprise upper support braces and lower support braces extending rearward therefrom, configured and arranged to support the chainsaw scabbard plumb against an exterior side wall of a bucket for an aerial bucket lift.

10. The chainsaw scabbard of claim 9, wherein the upper support braces are configured to extend upwards and underneath a lip at an upper end of the bucket when the chainsaw scabbard is placed thereon.

11. The chainsaw scabbard of claim 1, wherein the left hook and the right hook each comprise a top portion extending rearward from the left side member and right side member, respectively, and a back support portion depending from the top portion.

12. The chainsaw scabbard of claim 11, wherein the left hook and right hook further comprise a foot portion extending inwardly from the back support portion.

13. A chainsaw scabbard for a bucket lift, comprising:

a backboard having left, right, front and back sides;

a scabbard portion having a left side, right side and front side, the left side and right side of the scabbard portion attached to the left side and right side of the backboard, respectively, the scabbard portion forming a trapezoidal pocket between the scabbard portion and backboard, with a wider mouth at a top of the pocket and shallower opening at a bottom of the pocket, configured and arranged to hold a blade of a chainsaw therethrough;

a left side member and a right side member, the left side member and right side member each having a hogged out portion configured to cup an edge of the left side and right side, respectively, of the scabbard portion, the left side member and right side member fastened to the left side and right side of the backboard, respectively, through the left side and right side of the scabbard portion; and a left hook and a right hook extending from the left side member and right side member respectively, the left hook and right hook configured and arranged to couple to a bucket of an aerial bucket lift.

14. A chainsaw scabbard for a bucket lift, comprising:

a backboard having left, right, front and back sides;

a scabbard portion having a left side, right side and front side, the left side and right side of the scabbard portion attached to the left side and right side of the backboard, respectively, forming a pocket between the scabbard portion and backboard with a mouth at a top end and an opening at a bottom end of the scabbard portion, the bottom end tapering inwardly towards the backboard, the scabbard portion configured and arranged to hold a blade of a chainsaw therethrough, a portion of the backboard extending upwardly from the mouth of the pocket;

a left side member and a right side member, the left side member and right side member each having a hogged out portion configured to cup an edge of the left side and right side, respectively, of the scabbard portion, the left side member and right side member fastened to the left side and right side of the backboard, respectively, through the left side and right side of the scabbard portion; and a left hook and a right hook extending from the left side member and right side member respectively, the left hook and right hook configured and arranged to couple to a bucket of an aerial bucket lift.

* * * * *